US005767879A

United States Patent [19]

Tsukamoto et al.

[11] Patent Number: 5,767,879

[45] Date of Patent: Jun. 16, 1998

[54] IMAGE FORMING APPARATUS

[75] Inventors: Koji Tsukamoto, Yamatokoriyama; Takasumi Wada, Nara; Kenji Tani, Yamatokoriyama, all of Japan

[73] Assignee: Sharp Kabushiki Kaisha, Osaka, Japan

[21] Appl. No.: 735,514

[22] Filed: Oct. 23, 1996

[30] Foreign Application Priority Data

Oct. 24, 1995 [JP] Japan ..... 7-275744

[51] Int. Cl.[6] ..... B41J 2/05

[52] U.S. Cl. ..... 347/55; 399/241

[58] Field of Search ..... 347/55; 399/237, 399/241

[56] References Cited

U.S. PATENT DOCUMENTS

| | | | |
|---|---|---|---|
| 5,357,274 | 10/1994 | Kitamura | 347/55 |
| 5,600,355 | 2/1997 | Wada | 347/55 |
| 5,633,110 | 5/1997 | Desie et al. | 347/55 X |

FOREIGN PATENT DOCUMENTS 4-83658 3/1992 Japan .

*Primary Examiner*—Nestor R. Ramirez

*Attorney, Agent, or Firm*—David G. Conlin; John L. Welch

[57] ABSTRACT

An image forming apparatus has a toner carrier roller, a back electrode which is located so as to face the toner carrier roller, a voltage source for applying a voltage which generates an electric field for making toner fly from the toner carrier roller to the back electrode, a control electrode which has many openings through which the toner is allowed to pass and first and second conductive layers formed around the openings and is formed so that at least portions of the first and second conductive layers which surround the openings do not overlap each other in a direction where the toner flies from the toner carrier roller to the back electrode, and a voltage source for applying a voltage which controls the toner passing through the opening according to an image signal. As a result, an electrostatic capacity is hardly formed between the first conductive layer and the second conductive layer, thereby suppressing a fall in response characteristic to the toner flying control due to the electrostatic capacity.

11 Claims, 8 Drawing Sheets

IMAGE FORMING APPARATUS

FIELD OF THE INVENTION

The present invention relates to an image forming apparatus such as a facsimile, a copying machine and a printer, more specifically an image forming apparatus for applying a voltage to a control electrode according to an image signal such as inputted characters so as to control flying of a visualizing agent from a visualizing agent carrier through an opening of the control electrode towards a counter electrode and forming an image by making the visualizing agent adhere to a recording medium located between the visualizing agent control electrode and the counter electrode.

BACKGROUND OF THE INVENTION

Conventionally, an image forming apparatus for forming a visible image according to an electrical signal outputted from a computer, a word processor, a facsimile or the like on a recording medium such as paper has been known. Such an image forming apparatus adopts an ink-jet system for making ink jet from a nozzle, a thermal transfer system for transferring ink due to heating and fusing, a sublimation system, an electrophotography system, etc.

In the above image forming apparatuses, recently, an ink-jet-system image forming apparatus is widely used. This is because the ink-jet system progresses in high speed, high image quality and low price, and a comparatively simple arrangement can be provided to the apparatus with this system by a non-impact system and by integrating an ink cartridge and a print head as one unit. However, in the ink-jet system, since liquid ink is used, blots easily occur on a recording medium having a water absorption property such as paper. Therefore, it is not primarily suitable for obtaining a highly fine image.

For this reason, in the case where a highly fine image is required, an image forming apparatus adopting the electrophotography system for forming an image by using toner is used. Namely, when an image is formed by toner, a visually excellent image in which blots hardly occur, its outline is clear and color tone is deep can be obtained.

Accordingly, an image forming apparatus having advantages of the ink-jet system and the electrophotography system has been suggested recently. Such an image forming apparatus makes toner fly in synchronization with a transporting speed of a recording medium so as to make the toner adhere directly to the recording medium. In accordance with this image forming system, an arrangement of the image forming apparatus using toner becomes simple, and thus an excellent image can be obtained at a low price.

As the above image forming system, an arrangement shown in FIG. 6 is known. In this image forming apparatus, a control electrode 24 is provided between a toner carrier 22 and recording paper 27 as a recording medium, and an opening 24*d* through which toner passes is formed on the control electrode 24. Conductive layers 24*b* and 24*b*' are provided around the opening 24*d*. The conductive layers 24*b* and 24*b*' have, for example, a circular ring shape, and they are provided so as to independently control each voltage. Moreover, the conductive layers 24*b* and 24*b*' are connected to a voltage source. In this image forming apparatus, a voltage having opposite polarity to a charging polarity of toner 20 is applied to a back electrode 23 located on a back side of the recording paper 27 so that the toner 20 is made fly from the toner carrier 22 to the back electrode 23. Furthermore, a voltage according to an image signal is applied to the conductive layer 24*b* so that flying of the toner 20 which passes through the opening 24*d* is controlled. The recording paper 27 is transported by a transport belt 25.

In accordance with the above arrangement, the toner 20 is made fly by an electric field formed by the voltage applied across the toner carrier 22 and the back electrode 23. Moreover, when an electric field having opposite direction to the above-mentioned electric field is generated by applying a voltage to the control electrode 24 and thus the flying force of the toner 20 is decreased, a flying amount of the toner 20 is controlled. When a flying amount of the toner 20 is increased, the voltage to be applied to the control electrode 24 is lowered or in some cases, the polarity of this voltage is reversed. When the above control is exercised, the arrangement shown in FIG. 6 arises the following problems.

In the arrangement shown in FIG. 6, the toner carrier 22 is actually very close to the recording paper 27. For this reason, when the toner 20 adhering to the recording paper 27 through the opening 24*d* moves accordingly to the movement of the transport belt 25 in a direction of an arrow, in order to make the toner 20 fly, a toner flying voltage having opposite polarity to the toner 20 is applied to the conductive layers 24*b* and 24*b*'. Then, as shown in FIG. 7, the toner 20 which is hardly influenced by an adhering force due to the back electrode 23 in the toner 20 adhering to the recording paper 27 adheres to the control electrode 24. As a result, the control electrode 24 is stained. Moreover, as shown in FIG. 8, the toner 20 adhering to the control electrode 24 flies to the recording paper 27 again, and thus the toner 20 adheres to a domain to which the toner 20 should not adhere originally, thereby arising a problem of staining an image.

Therefore, for example, Japanese Unexamined Patent Publication No. 4-83685/1992 (Tokukaihei 4-83685) discloses "a toner-jet-type image forming apparatus" which is arranged so that a reference electrode section and an a.c. electrode section are provided on a control electrode, and an a.c. voltage is applied across the reference electrode section and the a.c. electrode section. In this arrangement, the adhesion of the toner to the control electrode can be prevented by an alternating electric field generated by applying the a.c. voltage, and thus high image quality is maintained stably for a long time.

However, in the arrangement disclosed in the above Publication, the alternating electric field whose direction changes every time when an image is formed in the proximity of the opening through which the toner of the control electrode passes. For this reason, the alternating electric field easily exerts a bad influence upon an electric field for making the toner fly, and thus there is impossibility of satisfactory toner flying control.

In addition, in the above arrangement disclosed in the Publication, since the control electrode section for controlling the toner flying and the reference electrode section are provided so as to overlap each other in the toner flying direction, a large electrostatic capacity is formed between both the electrode sections. Therefore, a response characteristic of the toner flying control is lowered due to the electrostatic capacity, and thus it is difficult to control the toner flying satisfactorily.

SUMMARY OF THE INVENTION

The present invention is invented in order to solve the above problems, and it is an object of the present invention to provide an image forming apparatus, having an arrangement that a plurality of electrode sections are provided on a control electrode, which is capable of suppressing the fall in the response characteristic of the toner flying control due to the electrostatic capacity between the electrode sections, and satisfactorily controlling the flying of toner for forming an image. Moreover, it is another object of the present invention to provide an image forming apparatus which is capable of preventing toner from adhering to a control electrode provided with an opening through which the toner passes without exerting a bad influence upon the toner flying control, and thus controlling the flying of toner for forming an image stably.

In order to achieve the above object, an image forming apparatus of the present invention is characterized by having:

a visualizing agent carrier for holding a visualizing agent charged so as to have a predetermined polarity;

a back electrode which faces the visualizing agent carrier;

a first voltage source for applying a voltage across the visualizing agent carrier and the back electrode, the voltage generating an electric field for making the visualizing agent fly from the visualizing agent to the back electrode;

a control electrode provided between the visualizing agent and the back electrode, the control electrode having many openings for allowing the visualizing agent to pass therethrough and first electrode sections and second electrode sections formed around the openings, the control electrode being formed so that at least portions of the first electrode section and the second electrode section which surround the openings do not overlap each other in a direction where the visualizing agent flies from the visualizing agent carrier to the back electrode; and a second voltage source for supplying a voltage, which controls the visualizing agent passing through the opening according to an image signal, to the control electrode.

In accordance with the above arrangement, when a voltage is applied across the visualizing agent carrier and the back electrode from the first voltage source, an electric field for making the visualizing agent fly from the visualizing agent carrier to the back electrode is generated. The visualizing agent held by the visualizing agent carrier tries to fly towards the back electrode due to this electric field.

Meanwhile, the passing of the visualizing agent through the opening of the control electrode is controlled by applying a voltage according to an image signal to the control electrode from the second voltage source. Therefore, when a recording medium such as paper is fed onto a surface of the back electrode on the side of the control electrode, an image is formed on the paper by the visualizing agent.

The first electrode section and the second electrode section on the control electrode are formed so that at least portions of the first electrode section and the second electrode section which surround the opening do not overlap each other in the direction where the visualizing agent flies from the visualizing agent carrier to the back electrode. Therefore, an electrostatic capacity is hardly formed between the first electrode section and the second electrode section, thereby suppressing a fall in the response characteristic to the toner flying control due to the electrostatic capacity. As a result, the flying of toner for forming an image can be controlled satisfactorily.

In addition, another image forming apparatus of the present invention is characterized by having:

a visualizing agent carrier for holding a visualizing agent charged so as to have a predetermined polarity;

a back electrode which faces the visualizing agent carrier;

a first voltage source for applying a voltage across the visualizing agent carrier and the back electrode, the voltage generating an electric field for making the visualizing agent fly from the visualizing agent carrier to the back electrode;

a control electrode provided between the visualizing agent carrier and the back electrode, the control electrode having many openings for allowing the visualizing agent to pass therethrough and first electrode sections for controlling the visualizing agent passing through the openings and second electrode sections to which a potential having the same polarity as the potential to be given to the visualizing agent carrier is given; and a second voltage source for applying a voltage, which controls the visualizing agent passing through the opening according to an image signal, to the first electrode section.

In accordance with the above arrangement, similarly to the aforementioned arrangement, an image is formed on paper by the visualizing agent.

Here, the visualizing agent which flies from the visualizing agent carrier to the back electrode due to the electric field tries to adhere to the control electrode. However, since a potential having the same polarity as a potential to be given to the visualizing agent carrier is given to the second electrode section of the control electrode, the adhesion of the visualizing agent is suppressed by an electric field due to the potential. In this case, since the potential to be given to the second electrode can be maintained constant, the electric field due to the potential hardly exerts a bad influence upon the electric field for making the toner fly.

As mentioned above, since the visualizing agent is prevented from adhering to the control electrode, a stain of the control electrode due to the visualizing agent, a stain of paper due to flying of the visualizing agent from the control electrode to the paper, an unstable potential of the control electrode due to adhesion of the visualizing agent having electric charges to the control electrode, etc. can be prevented. As a result, the flying of the toner can be controlled satisfactorily.

For fuller understanding of the nature and advantages of the invention, reference should be made to the ensuing detailed description taken in conjunction with the accompanying drawings.

BRIEF DESCRIPTION OF THE DRAWINGS

FIG. 3(*b*) is a schematic longitudinal section of a control electrode which shows a comparative example with respect to the arrangement shown in FIG. 3(*a*).

DETAILED DESCRIPTION OF THE PREFERRED EMBODIMENTS

The following explains one embodiment of the present invention on reference to FIGS. 1 through 5.

Figure 2:
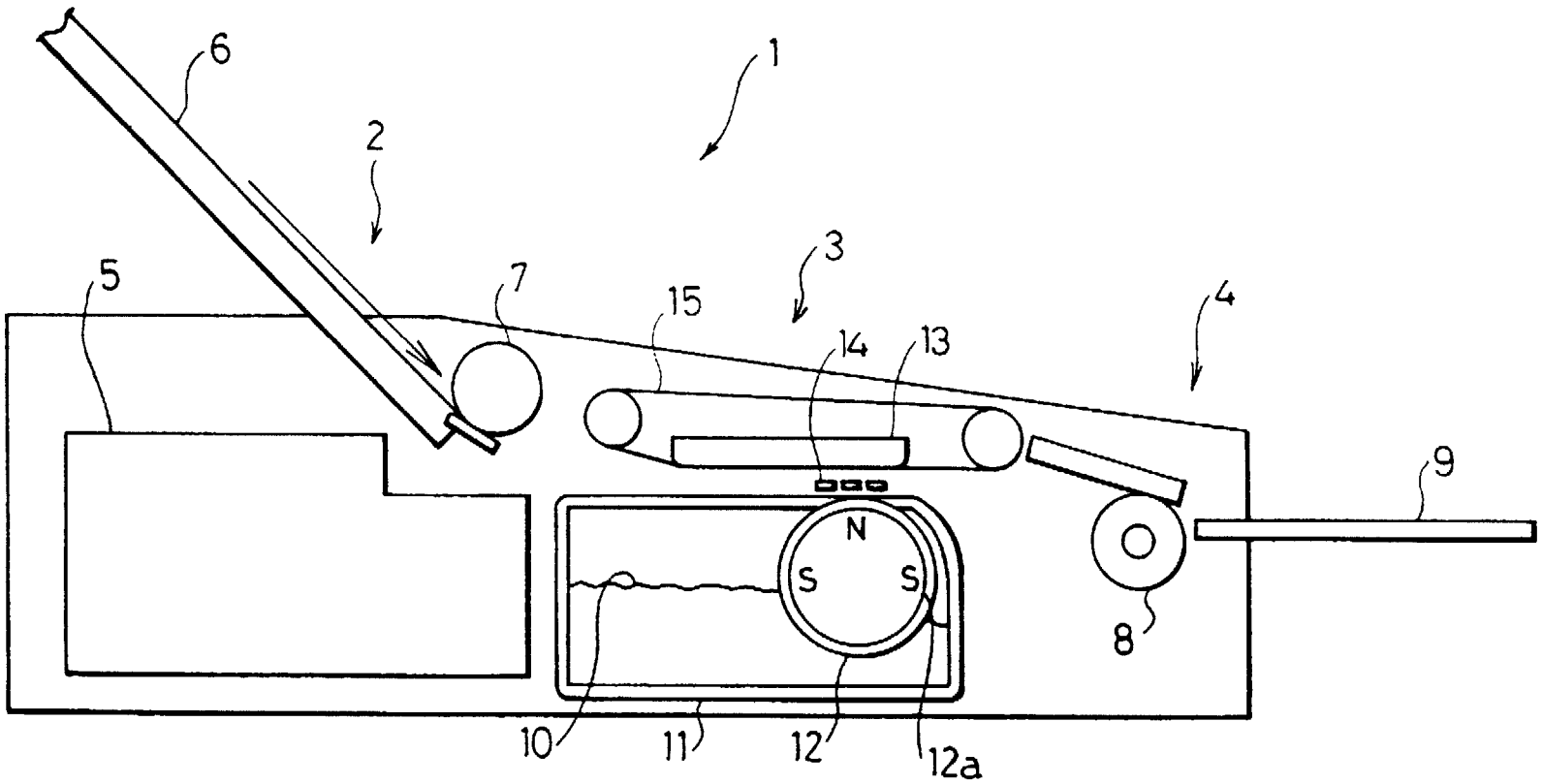
FIG. 2 is a schematic longitudinal section of the image forming apparatus having the image forming section shown in FIG. 1.
Figure 3A:
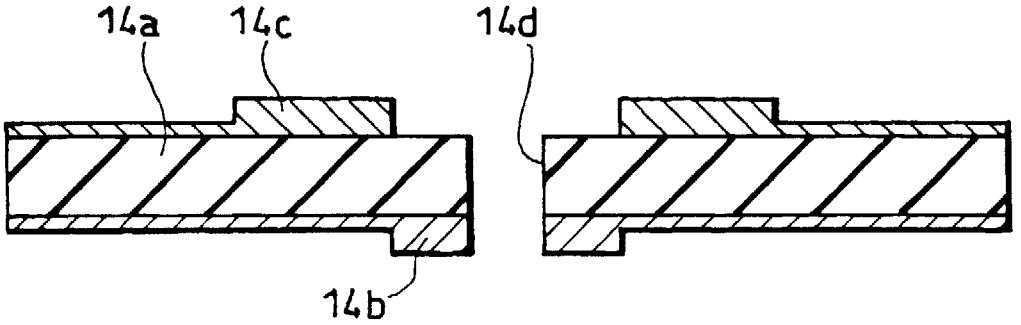
FIG. 3(*a*) is a schematic longitudinal section of a control electrode which shows an arrangement example of a conductive layer shown in FIG. 1.
Figure 3B:
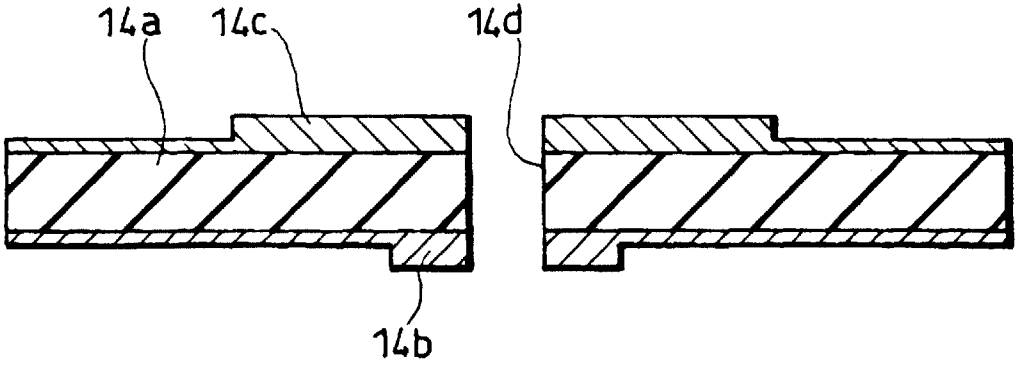

As shown in FIG. 2, an image forming apparatus 1 of the present embodiment is composed of a feeding section 2, an image forming section 3, a discharge section 4 and a controller box 5. The feeding section 2 is disposed of a feeding tray 6 for storing recording paper, not shown, and a feeding roller 7 for feeding paper. Moreover, the discharge section 4 is disposed of a discharge tray 9 and a fixing roller 8. The discharge tray 9 stores recording paper on which image formation is completed. The fixing roller 8 transports the recording paper to the discharge tray 9, and heats toner (visualizing agent) 10 on the recording paper so as to press the toner 10 against the recording paper.

In addition, the image forming section 3 has a toner tank 11, a toner carrier roller 12, a back electrode 13 and a control electrode 14.

The toner tank 11 stores the toner 10.

The toner carrier roller 12 is provided in the toner tank 11, and it holds and carries the toner 10. A magnet 12*a* whose North and South poles are arranged alternately is provided in the toner carrier roller 12. In the image forming apparatus 1 of the present embodiment, a two-component visualizing agent in which a magnetic carrier is mixed with toner 10 is used. Therefore, when the magnetic carrier adheres to the toner carrier roller 12 due to the magnetic 12*a*, and the toner 10 electrostatically adheres to the magnetic carrier, the toner 10 is carried.

The back electrode 13 is located so as to face the toner carrier roller 12, and the back electrode 13 is provided on the back side of the transport belt 15 for transporting the recording paper. A gap which is at least larger than a thickness of the recording paper, i.e. a transport path of the recording paper 17 is formed between the transport belt 15, which is transport means of the recording paper 17, and the control electrode 14. The recording paper is transported through the transport path.

Figure 1:
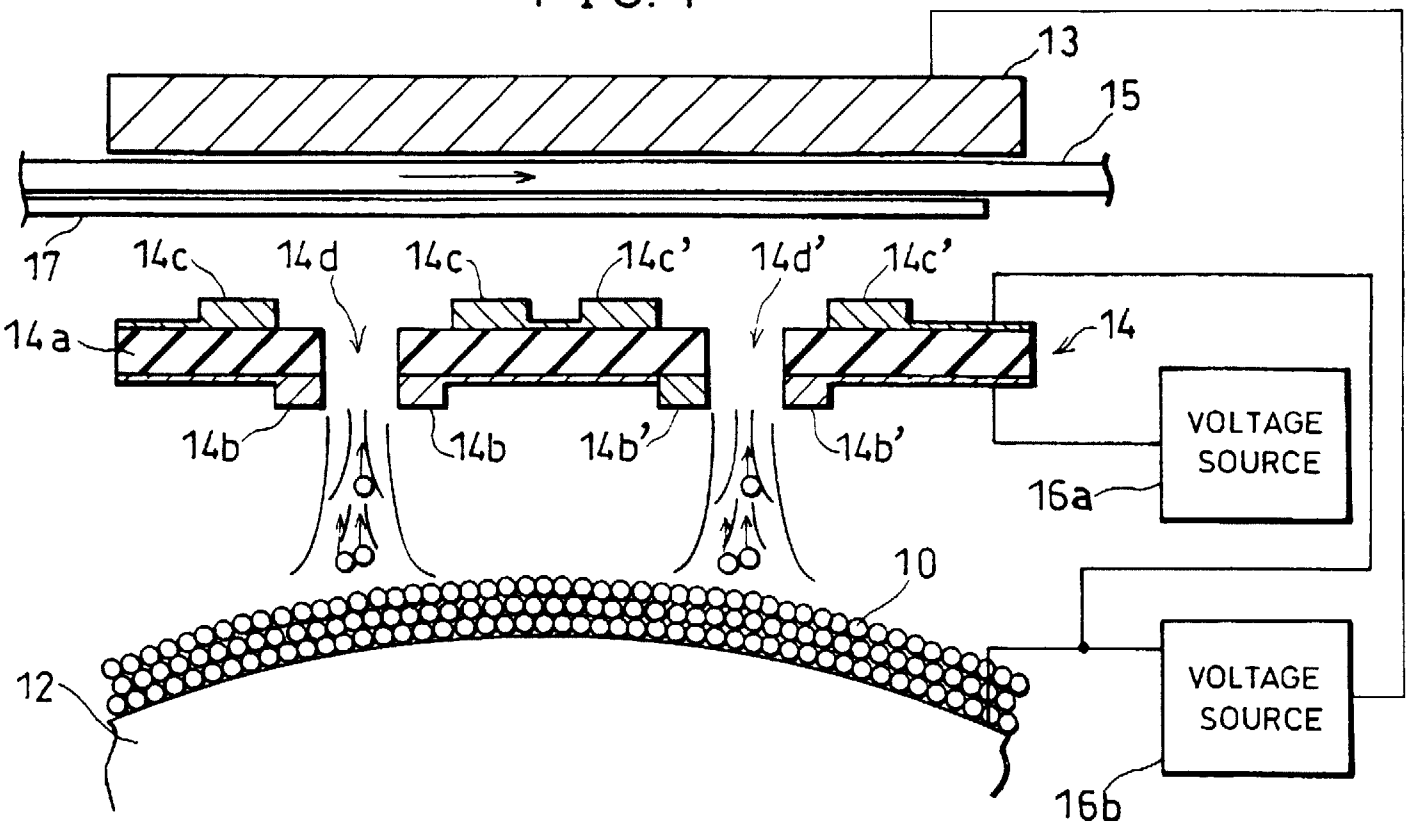
FIG. 1 is a schematic drawing which shows a main section of an image forming section in an image forming apparatus according to one embodiment of the present invention.

The control electrode 14 is provided between the toner carrier roller 12 and the back electrode 13 so that the control electrode 14 is close to the toner carrier roller 12. At this time, a gap is provided between the control electrode 14 and the toner carrier roller 12 so that the transport of the toner 10 through the toner carrier roller 12 is not prevented. As shown in FIG. 1, the control electrode 14 has a lot of openings through which the toner 10 passes, such as an opening 14*d* and an opening 14*d*'.

Meanwhile, a main controller substrate, a power source substrate, a high voltage generating circuit substrate, etc., not shown, are provided in the controller box 5. The main controller substrate is composed of an interface circuit section and an engine control circuit section, not shown. The interface circuit section detects a control signal relating to an operation of the image forming apparatus 1 and transmits the control signal to the engine control circuit section. Then, an image is formed based upon an image forming program stored in the engine control circuit section.

The following describes the operation of the image forming apparatus 1 in the above arrangement.

First, the interface circuit section of the main controller substrate in the controller box 5 receives an image formation starting signal transmitted from a host computer, not shown. The main controller drives a motor, not shown, according to the image formation starting signal. As a result, the toner carrier roller 12 connected to the motor by means of power transmission means is rotated. As a result, the toner 10 is agitated by the toner agitating roller, not shown, and a toner layer having a predetermined thickness is formed on the surface of the toner carrier roller 12. Next, the recording paper set on the feeding tray 6 is pulled out sheet by sheet by the feeding roller 7 so as to be sent to the image forming section 3.

In the image forming section 3, the recording paper is transported by the transport belt 15. Then, when the recording paper reaches a position which faces the control electrode 14, the toner 10 starts to fly from the toner carrier roller 12. The toner 10 passes through the openings 14*d* and 14*d*' and adheres to the recording paper so that an image is formed. Next, the image is fixed onto the recording paper by the fixing roller 8.

The recording paper on which the image has been formed through the above image forming process is discharged onto the discharge tray 9. As a result, a series of the image forming process is completed, the desired image can be obtained.

As shown in FIG. 1, the control electrode 14 has an insulating substrate 14*a*. The openings 14*d* and 14*d*' are formed so as to be bored through the insulating substrate 14*a*. The openings 14*d* and 14*d*' are formed in a position where adjacent dots are formed on the recording paper 17. Namely, the openings 14*d* and 14*d*' are arranged in such a position that the openings 14*d* and 14*d*' are forward and backward in the forward direction of the recording paper and are forward and backward in a direction intersecting perpendicularly to the forward direction of the recording paper 17. Moreover, a lot of the openings 14*d* and 14*d*' are respectively arranged in a direction which intersects perpendicularly to the forward direction of the recording paper 17.

A conductive layer (first electrode section) 14*b* and a conductive layer (first electrode section) 14*b*' for controlling the flying of toner are formed on the surface of the insulating substrate 14*a* which faces the toner carrier roller 12. Moreover, a conductive layer (second electrode section) 14*c* and a conductive layer (second electrode section) 14*c*' for preventing the toner from adhering to the control electrode 14 are formed on the surface of the insulating substrate 14 which faces the back electrode 13. These conductive layers 14*b*, 14*c*, 14*b*' and 14*c*' surround the openings 14*d* and 14*d*'. The conductive layers 14*b*, 14*c*, 14*b*' and 14*c*' have a circular ring shape, for example. The conductive layers 14*b* and 14*b*' can independently control voltages.

In addition, when viewed from one surface of the insulating substrate 14*a*, namely, in the direction where the toner 10 flies from the toner carrier roller 12 to the back electrode 13, the conductive layers 14*b* and 14*c* are located so that at least their portions which surround the opening 14*d* do not overlap each other. In the present embodiment, the conductive layer 14*b* is formed along an outer circumference of the opening 14*d*, and the conductive layer 14*c* is formed along an outer circumference of the conductive layer 14*b*. Moreover, a width of an electric conductor composing the conductive layer 14*c* is wider than a width of an electric conductor composing the conductive layer 14*b*.

The same positional relationship as the conductive layers 14b and 14c is applied to the conductive layers 14b' and 14c'. Here, since the positional relationship among the conductive layer 14b' and the conductive layer 14c' and the opening 14d' is the same as the positional relationship among the conductive layer 14b and the conductive layer 14c and the opening 14d, the description thereof is omitted except for the case where the description is required individually.

The conductive layer 14b is connected to a voltage source (second voltage source) 16a, and a voltage according to an image signal to be outputted from the main controller substrate is applied from the voltage source 16a to the conductive layer 14b. Since a voltage is applied to the conductive layer 14c from a voltage source (first voltage source) 16b used also for the toner carrier roller 12, the potential of the conductive layer 14c is maintained to the same level as the potential of the toner carrier roller 12.

In accordance with the above arrangement, when the toner 10 having negative polarity, for example, is used, a negative voltage is applied to the toner carrier roller 12, and a positive voltage is applied to the back electrode 13. These voltages are applied by the voltage source 16b. As a result, an electric field for making the toner 10 fly from the toner carrier roller 12 to the back electrode 13 is formed between the toner carrier roller 12 and the back electrode 13. At this time, a voltage which is controlled according to an image signal is applied from the voltage source 16a to the conductive layer 14b.

Therefore, an electric field, in which an electric field formed between the control electrode 14 and the toner carrier roller 12 by applying the voltage to the conductive layer 14b is combined with the electric field formed between the toner carrier roller 12 and the back electrode 13, is generated at the opening 14d. Then, when a force, which makes the toner 10 fly, due to the electric field becomes stronger than an attracting force between the toner 10 and the magnetic carrier, the toner 10 flies from the toner carrier roller 12. Hereinafter, the voltage level at this time is referred to as a toner flying voltage. On the contrary, when the force, which makes the toner 10 fly, due to the electric field is weaker than the attracting force, the toner 10 does not fly. Hereinafter, the voltage level at this time is referred to as a toner flying prevention voltage.

However, properties of individual toner 10 are slightly different, and the toner flying voltage and the toner flying prevention voltage are different according to the individual toner 10. Moreover, in order to improve a speed of response to the toner flying, a potential difference between the toner flying voltage and the toner flying prevention voltage is set between 300 and 400 V in the image forming apparatus 1. Here, it is not always necessary that the toner flying voltage has the same polarity as the toner flying prevention voltage.

Here, the relationship among the toner flying voltage and the toner flying prevention voltage and the flying of the toner 10 is summarized. When the toner flying voltage is applied to the conductive layer 14b, the toner 10 on the toner carrier roller 12 which faces the opening 14d tries to fly towards the back electrode 13. On the contrary, when the toner flying prevention voltage is applied to the conductive layer 14b, the toner 10 does not try to fly from the toner carrier roller 12. Therefore, the flying of the toner 10 can be controlled by switching a voltage between the toner flying voltage and the toner flying prevention voltage properly on the conductive layer 14b. The higher the switching speed, namely, the response characteristic is, the clearer an image becomes.

In addition, the same level of the voltage as the toner carrier roller 12 is applied to the conductive layer 14c on the side of the back electrode 13 by the voltage source 16b. As a result, the adhesion of the toner 10 to a domain of the control electrode 14 where the conductive layer 14b is not formed can be suppressed.

Namely, the domain where the conductive layer 14b is not formed is not influenced by the control voltage to be applied to the conductive layer 14b. As a result, the toner might fly to the domain due to the electric field formed between the toner carrier roller 12 and the back electrode 13. Therefore, in the present embodiment, a conductive layer 14c is formed on the control electrode 14 so as to cover a larger domain than the conductive layer 14b. The same level of the potential as the toner carrier roller 12 is given to the conductive layer 14c. Namely, when, for example, a negative potential is given to the toner carrier roller 12 as mentioned above, the negative potential is given also to the conductive layer 14c. Therefore, since an electric field having the toner flying direction is not formed in the domain where only the conductive layer 14c is formed, the flying and adhesion of the toner to the domain can be prevented.

In addition, when the toner 10 adhering to the recording paper 17 moves according to movement of the recording paper 17, if the toner flying voltage to be applied to the conductive layer 14b is positive, the toner 10 which is hardly influenced by the attracting force of the back electrode 13 tries to fly towards the conductive layer 14b. However, since the same potential of the voltage as the toner carrier roller 12 is applied to the conductive layer 14c, the toner 10 adhering to the recording paper 17 does not fly from the recording paper 17. Therefore, a deterioration in printing quality due to scraping off of the toner 10, a stain of the control electrode 14, and a stain of the recording paper 17 due to return of the toner 10, which flew to the control electrode 14, to the recording paper 17 can be prevented.

In addition, just after the printing is completed, while the recording paper 17 is discharged from the image forming section 3, the toner flying prevention voltage is applied to the conductive layer 14b. As a result, unnecessary toner does not adhere to the recording paper 17 from the toner carrier 12, and the toner 10 is removed from the control electrode 14 so as to be collected on the toner carrier roller 12. As a result, the flying of the toner 10 can be controlled stably by the control electrode 14, and the recording paper 17 can be prevented from being stained by suppressing the flying of the toner 10 from the control electrode 14 to the recording paper 17.

Figure 4:
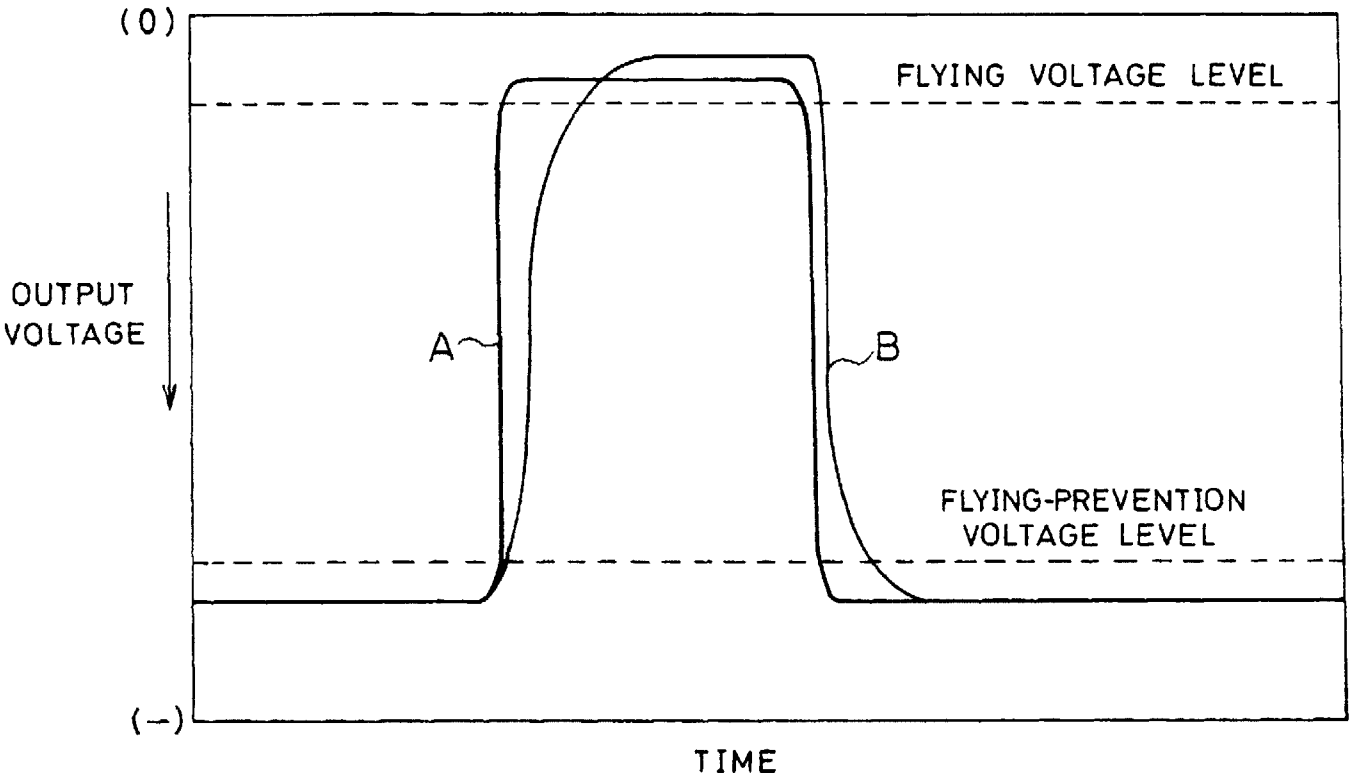
FIG. 4 is a graph which shows a response characteristic of the control electrodes (output voltage-time) shown in FIGS. 3(*a*) and (*b*).

In addition, since the conductive layer 14b and the conductive layer 14c are formed on the control electrode 14 in a direction which intersects perpendicularly to the surface of the insulating substrate 14a so as not overlap each other as mentioned above, an electrostatic capacity formed between the conductive layer 14b and the conductive layer 14c becomes very small, thereby improving the response characteristic at the time of controlling the toner. As to this function, FIG. 4 shows results of comparing a change in an output voltage with respect to a voltage to be applied according to time on a control electrode (data A) corresponding to the control electrode 14 shown in FIG. 3(*a*) and on a control electrode (data B) for comparison shown in FIG. 3 (*b*), for example. Here, a potential difference between the levels of the flying voltage and the flying prevention voltage shown in FIG. 4 is about 300–400 V. When the voltage is not higher than the flying prevention voltage, the toner does not fly. Meanwhile, when the voltage is not lower than the flying voltage, the toner flies. Moreover, when the data A and data B are obtained, potentials on each section are set to a same value.

As is clear from FIG. 4, in the data B, the response characteristic of the rising and the falling in the voltage change becomes dull, and the response characteristic of the output voltage with respect to a predetermined change in the voltage is unsatisfactory. This is caused by the following reason. The electrostatic capacity becomes large due to the overlapping of the conductive layer 14b and the conductive layer 14c, and electric charges are stored in the electrostatic capacity so that the control electrode 14 is hardly energized. As a result, the response characteristic becomes dull by the time for storing and releasing the electric charges.

Meanwhile, in the data A, the output voltage changes linearly with respect to a predetermined voltage change, and thus the response characteristic is further improved compared to the data B. This is because an electrostatic capacity is small between the conductive layer 14b and the conductive layer 14c due to no portion of the conductive layer 14b which overlaps the conductive layer 14c, and thus the above-mentioned problem does not arise.

If the potential having the same polarity as the toner carrier roller 12 is applied to the conductive layer 14c, the toner flying prevention function can be fulfilled. However, in order to fulfill the toner flying prevention function sufficiently, it is preferable that the potential is not lower than the potential of the toner carrier roller 12 and it has the same polarity as the toner carrier roller 12. Moreover, when the potential of the conductive layer 14c is set to the same level as the toner carrier roller 12, the voltage source 16b can be used for applying a voltage to the conductive layer 14c. Therefore, the configuration of the circuit can be compact and its cost can be low.

Figure 5:
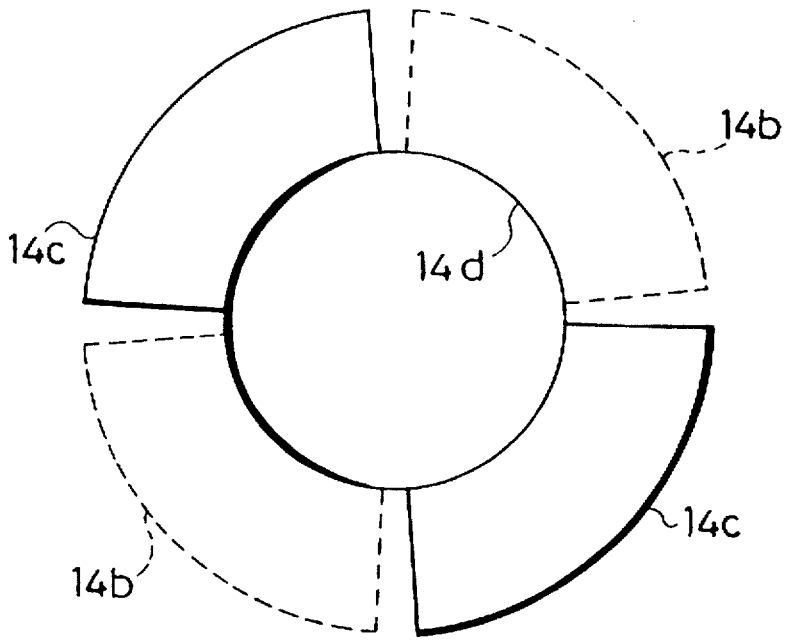
FIG. 5 is a plan view which shows an arrangement example of a conductive layer on the control electrode shown in FIG. 1.
Figure 6:
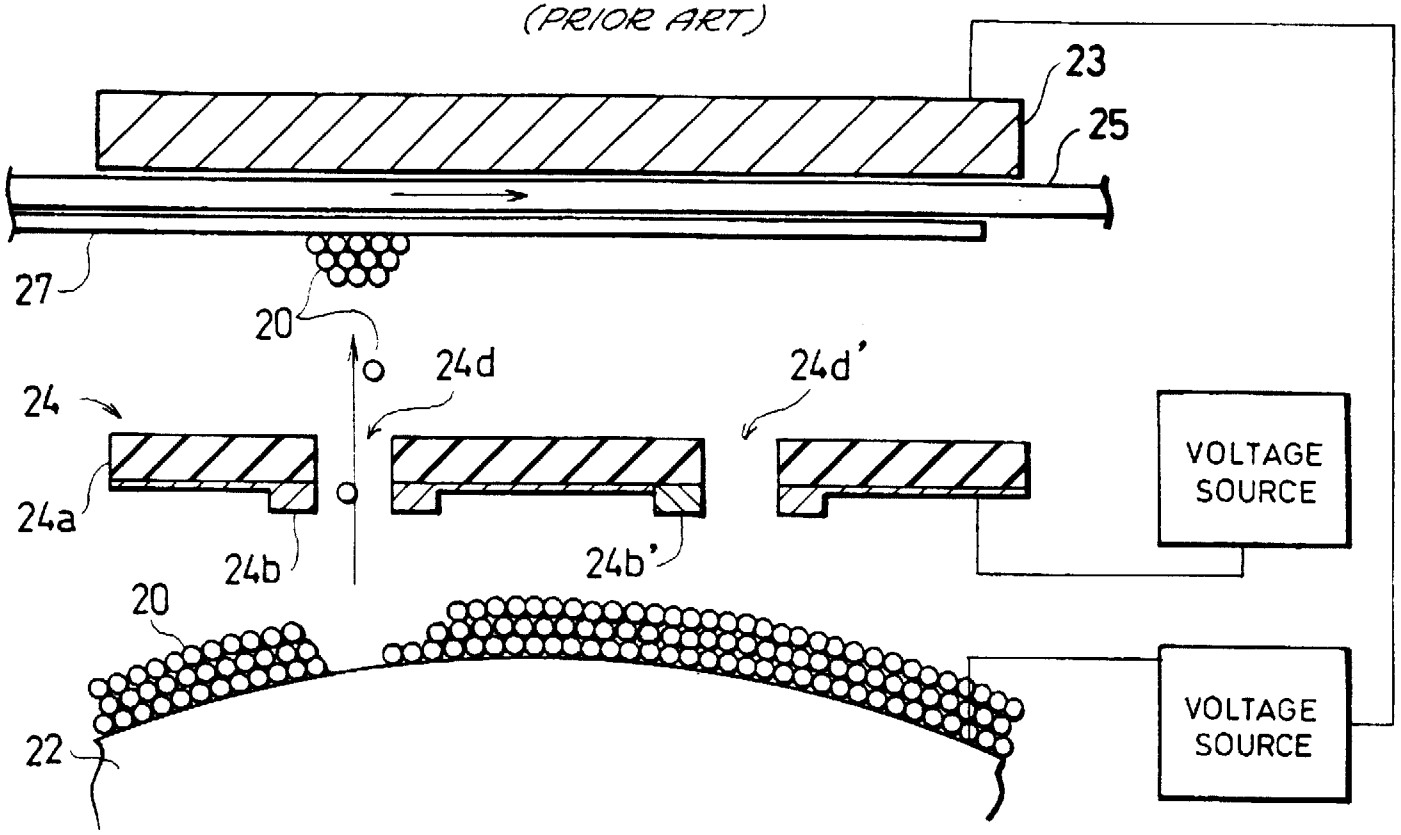
FIG. 6 (PRIOR ART)
FIG. 6 is a schematic drawing which shows a main section of an image forming section in a conventional image forming apparatus, and explains a problem at the time of toner flying.
Figure 7:
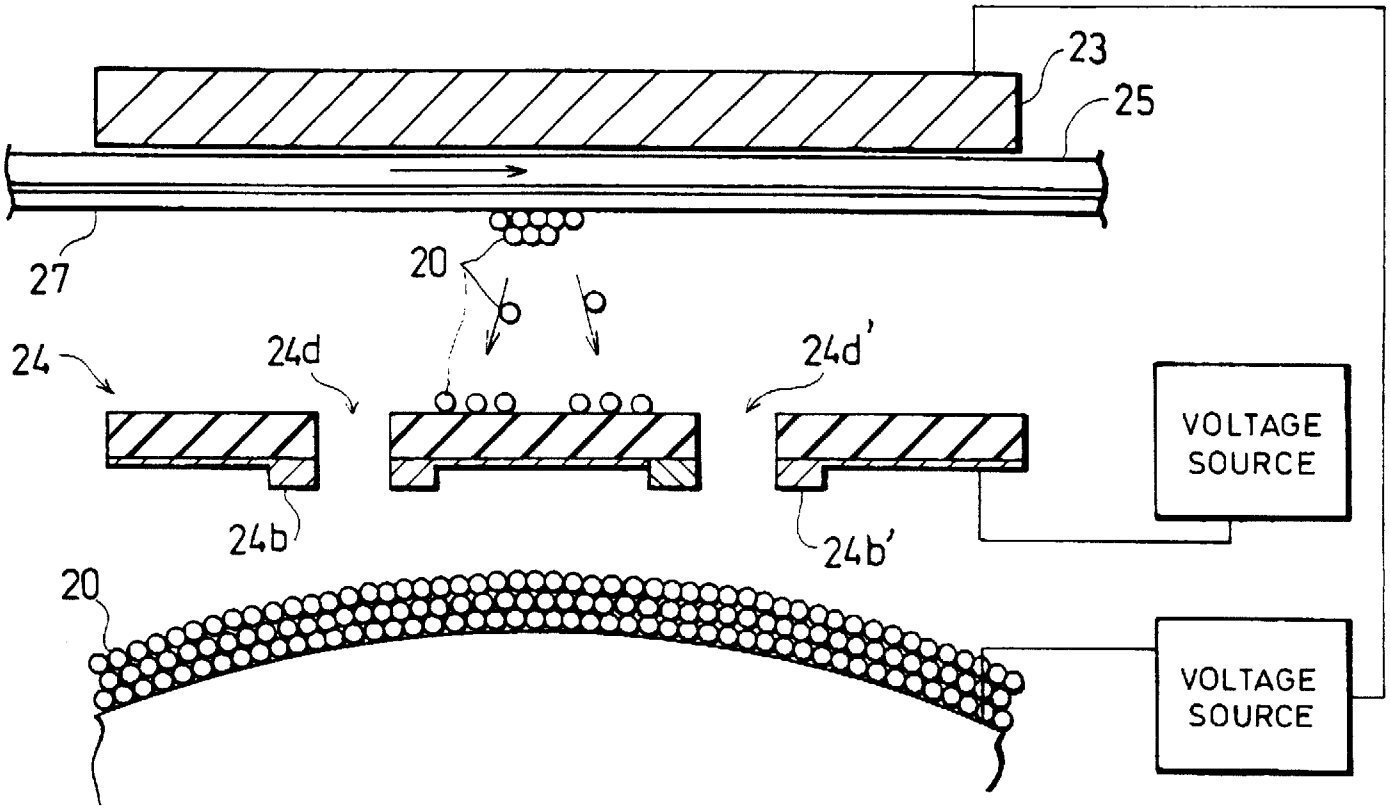
FIG. 7 (PRIOR ART)
FIG. 7 is an explanatory drawing which explains the problem at the time of toner flying in the image forming section shown in FIG. 6, and explains a state after the state shown in FIG. 6.
Figure 8:
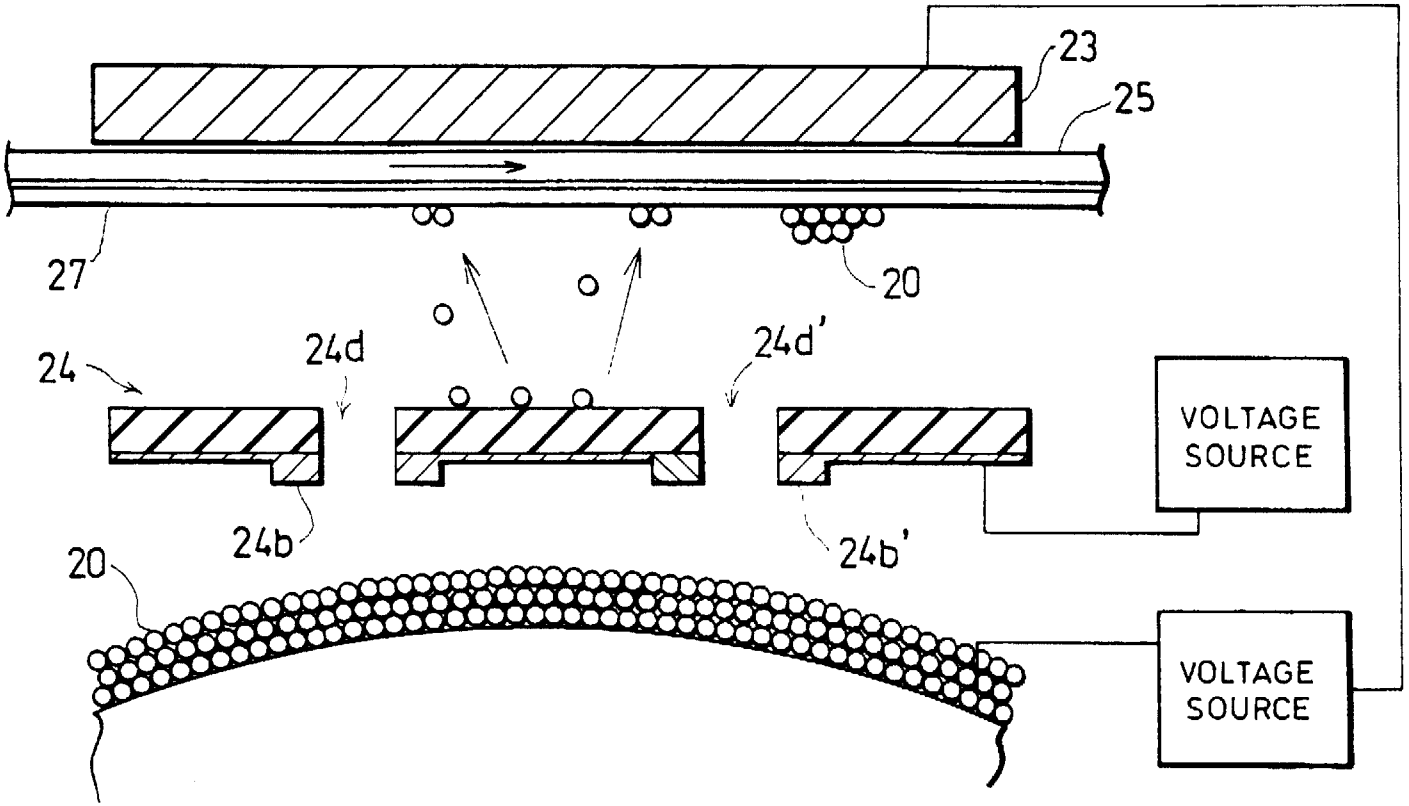
FIG. 8 (PRIOR ART)
FIG. 8 is an explanatory drawing which explains the problem at the time of toner flying in the image forming section shown in FIG. 6, and explains a state after the state shown in FIG. 7.

In addition, in FIG. 1, the conductive layer 14c is formed on the outer circumference of the conductive layer 14b, but its forming position is not limited as long as the conductive layer 14c does not overlap the conductive layer 14b. For example, as shown in FIG. 5, when the conductive layer 14b and the conductive layer 14c are formed to an ark-like shape so as to surround the opening 14d, and they do not overlap each other, an electrostatic capacity is not formed. As a result, the response characteristic to the voltage change becomes excellent.

In the image forming apparatus 1, since the conductive layer 14c is provided as mentioned above and a potential for suppressing the flying of the toner 10 is given to the conductive layer 14c, a flying amount of toner can be controlled accurately without deteriorating the response characteristic to the toner flying control, thereby forming a finer image.

In addition, since the toner carrier roller 12 and the conductive layer 14b are an electric conductor, and they are close to each other, an electrostatic capacity is formed therebetween. When the electrostatic capacity becomes large, the response characteristic at the time of forming an electric field is deteriorated due to electric charges stored in the electrostatic capacity. Moreover, in the case where an area of the conductive layer 14b is large, if a flying amount of toner is large, namely, a voltage for repulsing the toner 10 on the conductive layer 14b is small, the electric field by the conductive layer 14c for preventing adhesion of toner does not act and thus the toner 10 might adhere to the conductive layer 14b.

For example, since a lead supplies a voltage to each of the conductive layers 14b according to an image signal, the lead is individually formed on each of the conductive layers 14b. Here, one opening 14d corresponds to one dot of an image. Therefore, in order to obtain resolution of 300 dpi with respect to the recording paper 17 of A4 whose feeding direction is a longitudinal direction, about 2560 openings 14d with a line head arrangement, i.e. 2560 conductive layers 14d are required. Therefore, when an area of the lead connected to the conductive layer 14b is compared with the area of the conductive layer 14b, the area of the lead cannot be ignored.

Therefore, in order to decrease the electrostatic capacity so as to improve the response characteristic, and in order to solve the problem of the adhesion of the toner 10, it is desirable that the width of the electric conductor forming the conductive layer 14b and the width of the lead for connecting the voltage source 16a to the conductive layer 14b are made as narrow as possible. In the present embodiment, the width of the lead is made narrower than the width of the electric conductor so that the above problems are suppressed.

In addition, when the lead is located parallel with an axial direction of the toner carrier roller 12, namely, the longitudinal direction, the electrostatic capacities formed between the leads of the respective conductive layers 14b and the toner carrier roller 12 are different from one another, and thus it becomes difficult to control a control voltage to be applied to the conductive layer 14b. Moreover, the electrostatic capacity is increased. Therefore, it is desirable to avoid locating the lead parallel with the longitudinal direction of the toner carrier roller 12.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a visualizing agent carrier for holding a visualizing agent charged so as to have a predetermined polarity;

a back electrode which faces said visualizing agent carrier;

a first voltage source for applying a voltage across said visualizing agent carrier and said back electrode, the voltage generating an electric field for making the visualizing agent fly from said visualizing agent carrier to said back electrode;

a control electrode provided between said visualizing agent carrier and said back electrode, said control electrode having many openings for allowing the visualizing agent to pass therethrough and first electrode sections and second electrode sections formed around the openings, said control electrode being formed so that at least portions of the first electrode section and the second electrode section which surround the opening do not overlap each other in a direction where the visualizing agent flies from said visualizing agent carrier to said back electrode; and a second voltage source for supplying a voltage, which controls the visualizing agent passing through the opening according to an image signal, to said control electrode.

2. The image forming apparatus according to claim 1, wherein said control electrode has an insulating base material, the first electrode section is provided on a surface of the insulating base material on the side of said visualizing agent carrier, and the second electrode section is provided on a surface of the insulating base material on the side of said back electrode.

3. The image forming apparatus according to claim 2, wherein the opening has a circular shape, the first electrode section is formed to a circular ring shape along an outer circumference of the opening and the second electrode section is formed to a circular ring shape along an outer circumference of the first electrode section.

4. The image forming apparatus according to claim 3, wherein a width of an electric conductor forming the second electrode section is wider than a width of an electric conductor forming the first electrode section.

5. The image forming apparatus according to claim 2, wherein the opening is formed to a circular shape, and the first electrode section and the second electrode section are located so as to describe a coaxial circular arc with its center at a center of the opening.

6. The image forming apparatus according to claim 1, wherein a potential having same polarity as a potential to be given to said visualizing agent carrier is given to the second electrode sections.

7. The image forming apparatus according to claim 1, wherein the potential to be given to the second electrode sections is given from said first voltage source.

8. The image forming apparatus according to claim 6, wherein the potential is given to the second electrode sections after an image forming process is completed by flying of the visualizing agent from said visualizing agent carrier to said back electrode.

9. An image forming apparatus comprising:

a visualizing agent carrier for holding a visualizing agent charged so as to have a predetermined polarity;

a back electrode which faces said visualizing agent carrier;

a first voltage source for applying a voltage across said visualizing agent carrier and said back electrode, the voltage generating an electric field for making the visualizing agent fly from said visualizing agent carrier to said back electrode;

a control electrode provided between said visualizing agent carrier and said back electrode, said control electrode having many openings for allowing the visualizing agent to pass therethrough and first electrode sections for controlling the visualizing agent passing through the openings and second electrode sections to which a potential having the same polarity as the potential to be given to said visualizing agent carrier is given by said first voltage source; and a second voltage source for applying a voltage, which controls the visualizing agent passing through the opening according to an image signal, to the first electrode section.

10. The image forming apparatus according to claim 9, wherein said control electrode has an insulating base material, the first electrode section is provided on a surface of the insulating base material on the side of said visualizing agent carrier, and the second electrode section is provided on a surface of the insulating base material on the side of said back electrode.

11. The image forming apparatus according to claim 9, wherein the potential is given to the second electrode section after an image forming process is completed by flying of the visualizing agent from said visualizing agent carrier to said back electrode.

* * * * *